US008414289B2

(12) United States Patent
Feng

(10) Patent No.: US 8,414,289 B2
(45) Date of Patent: Apr. 9, 2013

(54) WHIRLWIND-TYPE OXIDATION COMBUSTION APPARATUS FOR PROCESSING SEMICONDUCTOR FABRICATION EXHAUST GAS

(75) Inventor: Wu Liang Feng, Chu-Pei (TW)

(73) Assignee: Orient Service Co., Ltd., Taipei (TW)

( * ) Notice: Subject to any disclaimer, the term of this patent is extended or adjusted under 35 U.S.C. 154(b) by 285 days.

(21) Appl. No.: 13/041,390

(22) Filed: Mar. 5, 2011

(65) Prior Publication Data

US 2012/0115098 A1 May 10, 2012

(30) Foreign Application Priority Data

Nov. 8, 2010 (TW) ..... 99138328 A

(51) Int. Cl.
*F23J 15/00* (2006.01)

(52) U.S. Cl.
USPC ..... 431/5; 431/8; 431/9

(58) Field of Classification Search ..... 431/5, 8, 431/9, 182, 185, 284; 110/345
See application file for complete search history.

(56) References Cited

U.S. PATENT DOCUMENTS 3,791,796 A * 2/1974 Gamble et al. ..... 422/182
4,116,618 A * 9/1978 Straitz, III ..... 431/202
5,310,337 A * 5/1994 Lifshits et al. ..... 431/174

FOREIGN PATENT DOCUMENTS

TW 482038 4/2002
TW 570146 1/2004

* cited by examiner

*Primary Examiner* — Kenneth Rinehart
*Assistant Examiner* — Jorge Pereiro
(74) *Attorney, Agent, or Firm* — Chun-Ming Shih

(57) ABSTRACT

A whirlwind-type oxidation combustion apparatus for processing semiconductor fabrication exhaust gas is disclosed. An inlet head is set on the top of an exhaust gas processing tank. An exhaust gas passage is set inside the inlet head and connected to an external exhaust gas supply terminal and the exhaust gas processing tank, for guiding the exhaust gas into the exhaust gas processing tank. An ignition chamber is formed between two partitions outside the exhaust gas passage. The two partitions have multiple inclined holes interconnecting an external combustion gas supply terminal, the ignition chamber, and the exhaust gas processing tank. The inclined holes guide a combustion gas to swirl into the exhaust gas processing tank through the ignition chamber. An igniter in the ignition chamber ignites the combustion gas to form a vortex flame which burns the exhaust gas. The exhaust gas is further caused to swirl onto a water screen.

7 Claims, 7 Drawing Sheets

WHIRLWIND-TYPE OXIDATION COMBUSTION APPARATUS FOR PROCESSING SEMICONDUCTOR FABRICATION EXHAUST GAS

BACKGROUND

1. Technical Field

The present invention relates to a whirlwind-type oxidation combustion apparatus for processing semiconductor fabrication exhaust gas. More particularly, the present invention relates to an inlet head for processing semiconductor fabrication exhaust gas, wherein inside the inlet there are an exhaust gas passage, an ignition chamber, and inclined holes for guiding the exhaust gas.

2. Related Art

The semiconductor fabrication process will generate exhaust gases that are toxic, erosive, and inflammable. To prevent the exhaust gases from causing environment pollution, the exhaust gases can be discharged to the atmosphere only after the toxic objects in the exhaust gases have been filtered out.

In a conventional method of processing semiconductor fabrication exhaust gas, the exhaust gas is firstly injected into an exhaust gas processing tank. The high temperature flame in the exhaust gas processing tank will burn the exhaust gas to produce a high temperature exhaust gas, causing the toxic objects in the high temperature exhaust gas to be catalyzed by the high temperature and to decompose into harmless objects. Then, wash water inside the exhaust gas processing tank will dissolve the dissolvable toxic objects in the high temperature exhaust gas and hence convert the high temperature exhaust gas into a harmless and cooled gas. Then, the cooled harmless gas can be discharged to the atmosphere without causing environment pollution.

Generally, on the top of a conventional exhaust gas processing tank there is an inlet head that allows an exhaust gas and an oxygen-containing combustion gas to be injected. The exhaust gas and the oxygen-containing combustion gas will be mixed up, and the oxygen-containing combustion gas will be ignited to produce high temperature flame to burn the exhaust gas.

Currently, there are some commercially-applied methods of processing semiconductor fabrication exhaust gas using high temperature flame and wash water as discussed above. Examples of such methods include Taiwan Patents No. 482038 and No. 570146. They use the inlet head on the top of the exhaust gas processing tank to produce high temperature flame to pre-burn the exhaust gas injected from an external exhaust gas supply terminal into the inlet head. They then spray or overflow wash water to produce a water screen inside the exhaust gas processing tank underneath the inlet head to dissolve toxic objects within the exhaust gas.

However, according to the two Taiwan Patents, the exhaust gas has a direct path through the inlet head and the exhaust gas processing tank. In other words, the exhaust gas has a direct path through the high temperature flame and the wash water. This inevitably limits the interaction time between the exhaust gas and the high temperature flame and the wash water. Without enough interaction time, the toxic objects might not be fully burned by the high temperature flame and fully dissolved in the wash water. This is a drawback that needs to be resolved.

BRIEF SUMMARY

One of the objectives of the present invention is to overcome the problem of the related art, in which the semiconductor fabrication exhaust gas has a direct path through the high temperature flame and the wash water and hence has limited interaction time with the high temperature flame and the wash water.

According to the present invention, the whirlwind-type oxidation combustion apparatus for processing semiconductor fabrication exhaust gas has an inlet head set in between an exhaust gas supply terminal and a combustion gas supply terminal. The inlet head locates on the top of an exhaust gas processing tank. An outer water screen is formed on the inner wall of the exhaust gas processing tank. The inlet head includes an exhaust gas passage, an upper partition and a lower partition, a plurality of upper inclined holes, an igniter, and a plurality of lower inclined holes.

The exhaust gas passage is connected in between the exhaust gas supply terminal and the exhaust gas processing tank, for guiding the exhaust gas down into the exhaust gas processing tank.

The upper partition and the lower partition lie in between the surrounding of the exhaust gas passage and the inner wall of the inlet head. An ignition chamber is formed in between the surrounding of the exhaust gas passage, the inner wall of the inlet head, and the upper and lower partitions.

The upper inclined holes scatter in a vortex pattern on the upper partition and encircle the surrounding of the exhaust gas passage. The upper inclined holes interconnect the combustion gas supply terminal and the ignition chamber, for guiding the combustion gas to swirl down into the ignition chamber.

The igniter is planted in the ignition chamber, for igniting the combustion gas in the ignition chamber to form a vortex flame to heat up the exhaust gas in the exhaust gas passage.

The lower inclined holes scatter in a vortex pattern on the lower partition and encircle the surrounding the exhaust gas passage. The lower inclined holes interconnect the ignition chamber and the exhaust gas processing tank. The lower inclined holes guides the flame to swirl into the exhaust gas processing tank, combusting the exhaust gas entered from the exhaust gas passage into the exhaust gas processing tank, causing toxic objects in the exhaust gas to be catalyzed by high temperature and decompose into harmless objects. The flam further leads the exhaust gas to swirl onto a water screen, causing the toxic objects in the exhaust gas to dissolve into the water screen. As a result, the exhaust gas will be cooled and become a harmless gas.

Because the upper and lower inclined holes have the same swirling direction, after the combustion gas that swirls into the ignition chamber through the upper inclined holes is ignited and becomes the flame, the combustion gas will swirl into the exhaust gas processing tank through the lower inclined holes and forms a flame that swirls down. This will cause the exhaust gas in the exhaust gas processing tank to swirl downwards. Accordingly, the vortex flame will cause the semiconductor fabrication exhaust gas to swirl down and pass through the high temperature flame (which is swirling) and wash water. This gives the exhaust gas more time to interact with the swirling flame and the wash water. This increases the efficiency of the flame in eliminating the harmful objects in the exhaust gas. Furthermore, the water screen has more time to dissolve the harmful objects in the exhaust gas and prevents the inner wall of the exhaust gas processing tank from dirt accumulation and erosion.

In addition, the present invention further discloses the followings:

A combustion gas chamber is formed between the surrounding of the exhaust gas passage, the top of the upper partition, and the inner wall of the inlet head. The combustion gas chamber interconnects the combustion gas supply terminal and the upper inclined holes so that the combustion gas is evenly provided to the upper inclined holes.

The combustion gas chamber has a container pipe that is connected to the ignition chamber. The igniter is set inside the container pipe. The container pipe has a plurality of air vents that interconnect the interior of the container pipe and the combustion gas chamber, for guiding the combustion gas into the container pipe to be ignited by the igniter and become a pilot light.

On a corresponding end beneath the exhaust gas passage and the lower inclined holes there is a combustion chamber sink. The combustion chamber sink interconnects the exhaust gas passage and the lower inclined holes. The bottom of the combustion chamber sink has a sink opening that is connected to the exhaust gas processing tank.

An annular upper sink is formed between the surrounding of the ignition chamber and the inner wall of the inlet head, for guiding in external wash water. An upper overflow opening is connected between the upper sink and the interior of the exhaust gas processing tank, for guiding the wash water to overflow into the exhaust gas processing tank to form an inner water screen on the inner side of the outer water screen. The inner water screen is to be blown by the exhaust gas and will dissolve toxic objects in the exhaust gas.

An annular collecting trough is formed between the surrounding of the ignition chamber and the inner wall of the inlet head. The annular collecting trough is connected to the upper sink and locates on the top of the upper sink. The external wash water is guided into the upper sink through the collecting trough.

An annular lower sink is formed on the inner wall of the exhaust gas processing tank for guiding in external wash water. A lower overflow opening interconnects the lower sink and the interior of the exhaust gas processing tank. The lower overflow opening guides the wash water to overflow into the exhaust gas processing tank to form the outer water screen.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
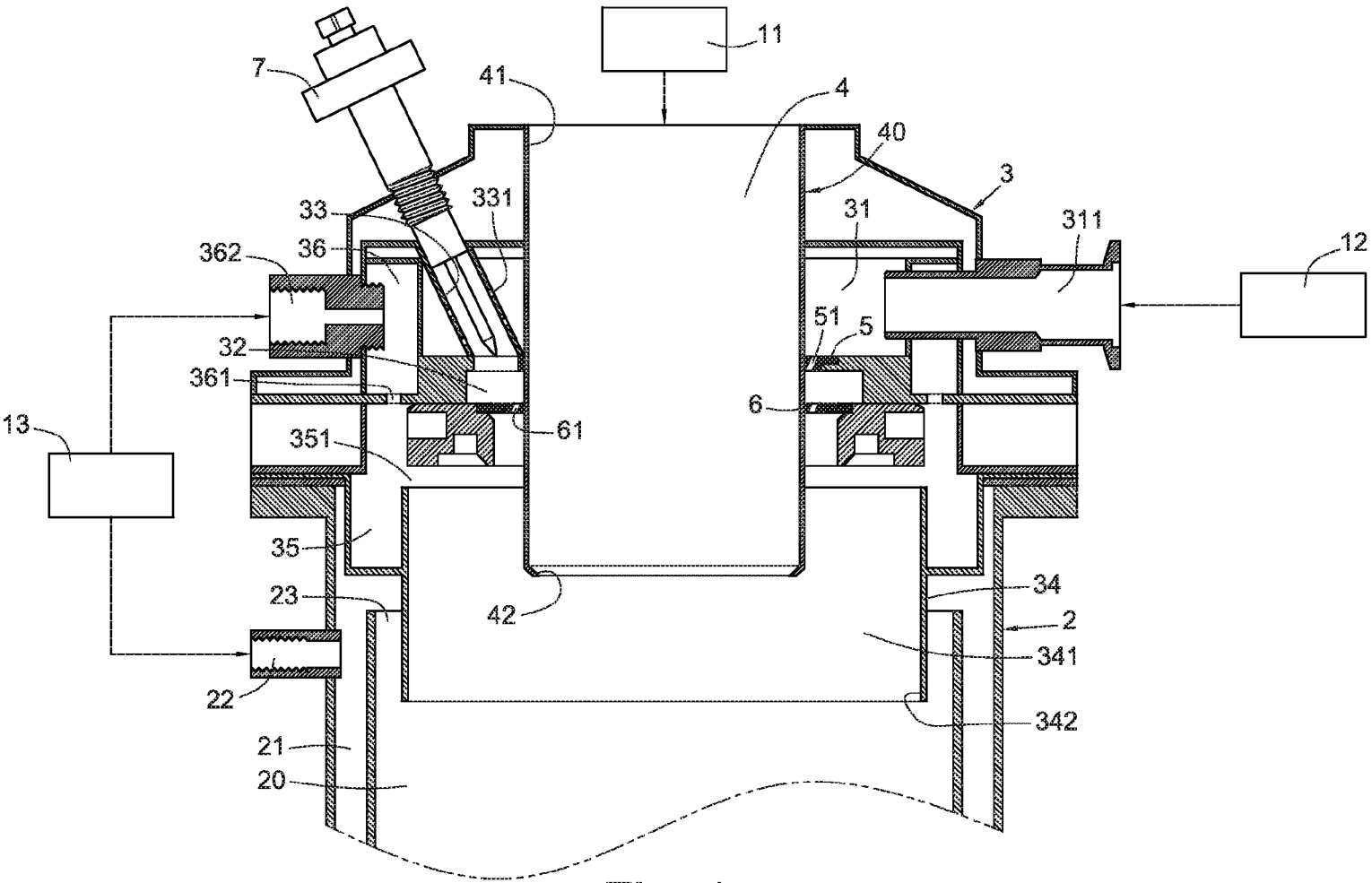
FIG. 1 shows a cross-sectional view of an embodiment of the present invention.
Figure 2:
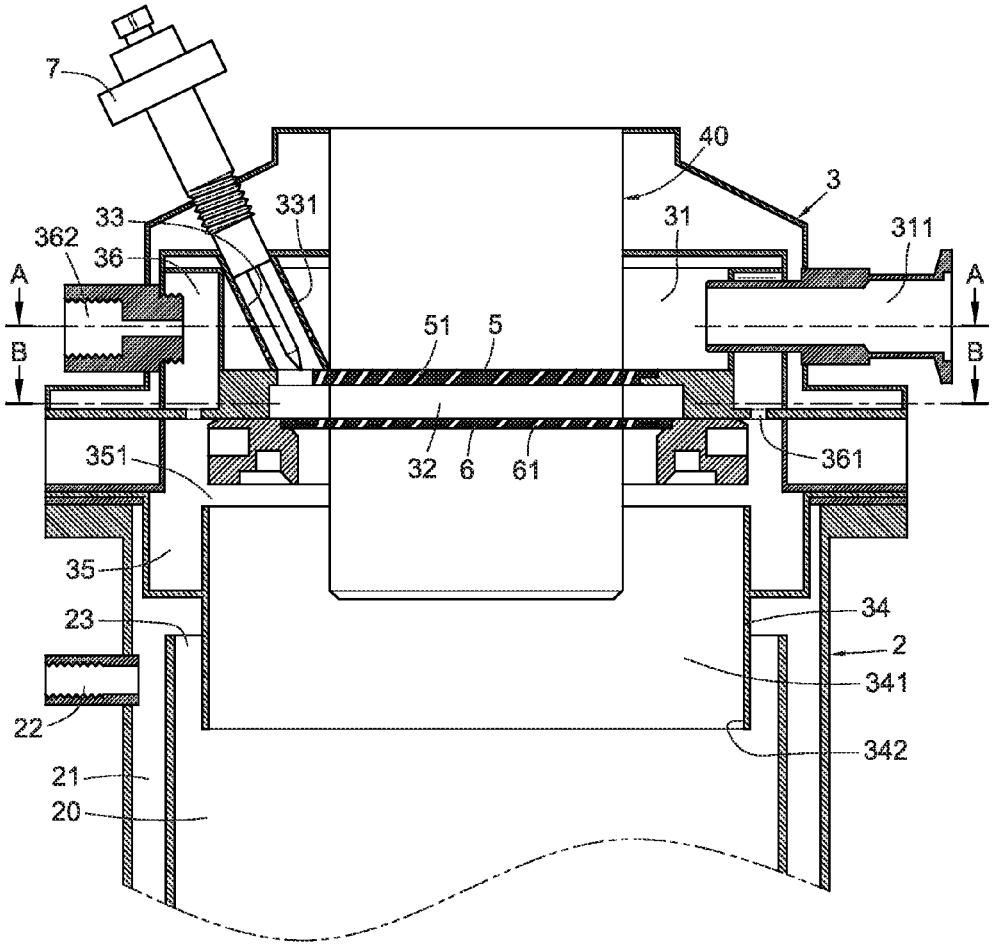
FIG. 2 shows another cross-sectional view of the embodiment of the present invention.
Figure 7:
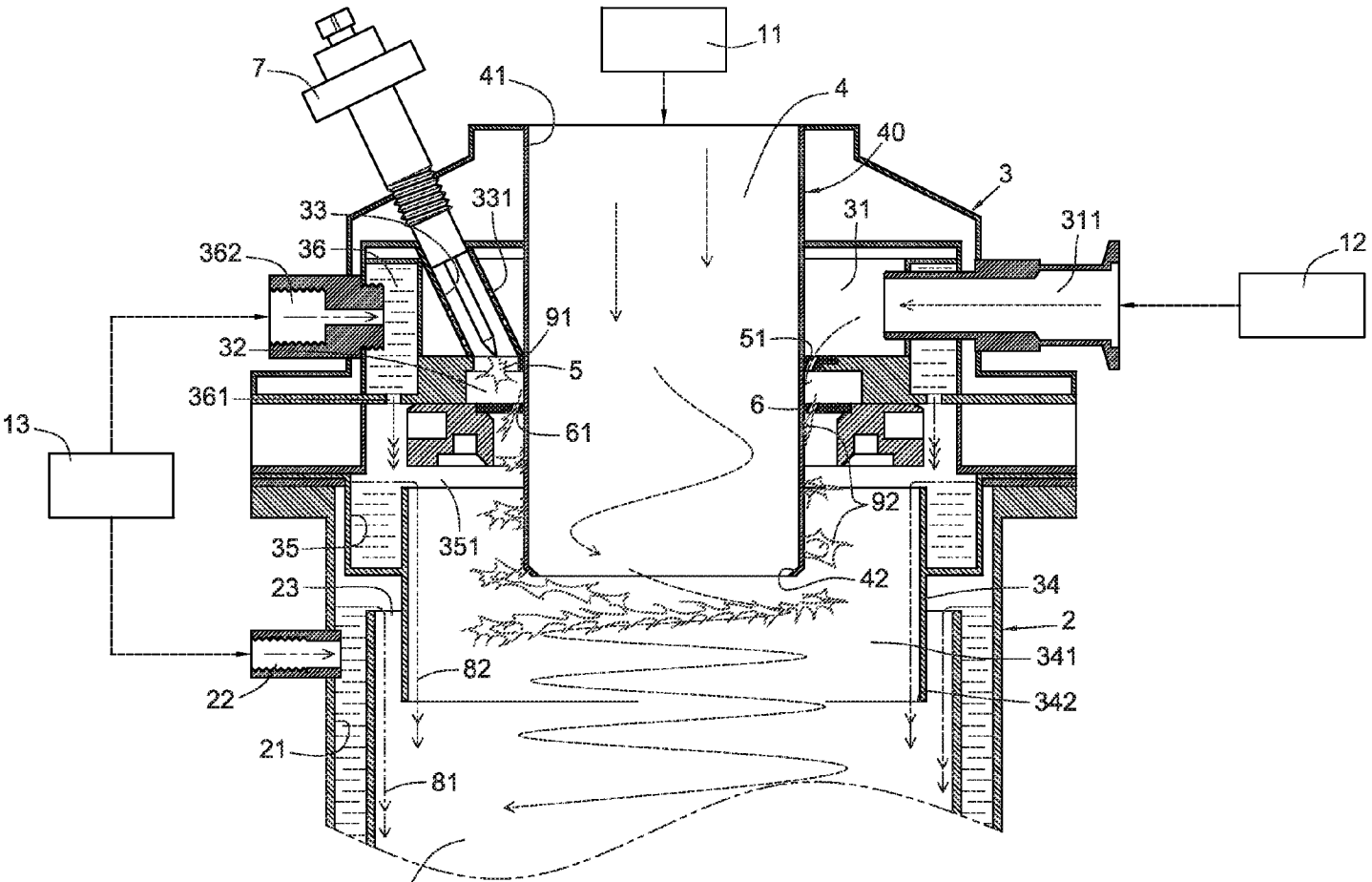
FIG. 7 shows how the embodiment in FIG. 1 operates.

FIG. 1 and FIG. 2 are cross-sectional diagrams of a whirlwind-type oxidation combustion apparatus according to an embodiment of the present invention. The apparatus is used to process a semiconductor fabrication exhaust gas. According to the embodiment, an inlet head 3 is set in between a semiconductor fabrication exhaust gas supply terminal 11 and a combustion gas supply terminal 12. The inlet head 3 lies on the top of an exhaust gas processing tank 2. An outer water screen 81 is formed on the inner wall of the exhaust gas processing tank 2 (as shown in FIG. 7). The inlet head 3 contains a vertical exhaust gas passage 4, an upper partition 5, a lower partition 6, a plurality of upper inclined holes 51, an igniter 7, and a plurality of lower inclined holes 61. The combustion gas supply terminal 12 supplies a combustion gas that contains 5%~15% of natural gas and 95%~85% of air. A conventional Venturi tube pre-mixer, which locates externally, can pre-mix the natural gas and external air to form the oxygen-contained combustion gas. This avoids the necessity of providing oxygen alone. The exhaust gas processing tank 2 has a reaction chamber 20 in its center. The inner wall of the exhaust gas processing tank 2 forms a lower sink 21 that is annular in shape. The outer wall of the exhaust gas processing tank 2 has a second water inlet 22 that is connected to the lower sink 21. To supply wash water to the lower sink 21, the second water inlet 22 can be connected with an outer wash water supply terminal 13. A lower overflow opening 23, which is annular in shape, interconnects the top of the lower sink 21 and the reaction chamber 20 inside the exhaust gas processing tank 2. The wash water in the lower sink 21 can be guided by the lower overflow opening 23 to overflow into the reaction chamber 20 of the exhaust gas processing tank 2, and flow down along the inner wall of the reaction chamber 20 to form an outer water screen 81.

Figure 3:
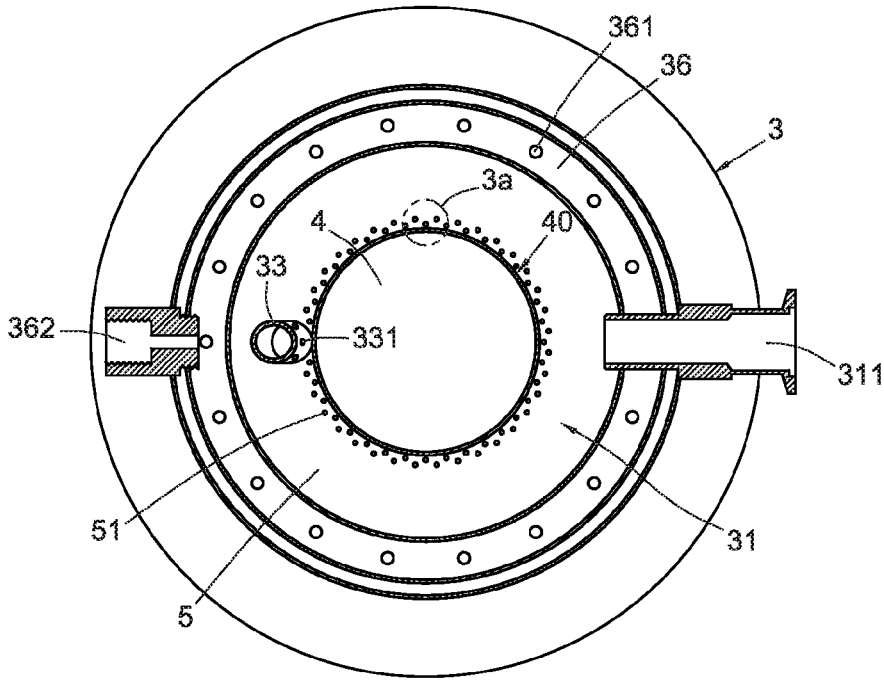
FIG. 3 shows a cross-sectional view along the line A-A in FIG. 2.
Figure 5:
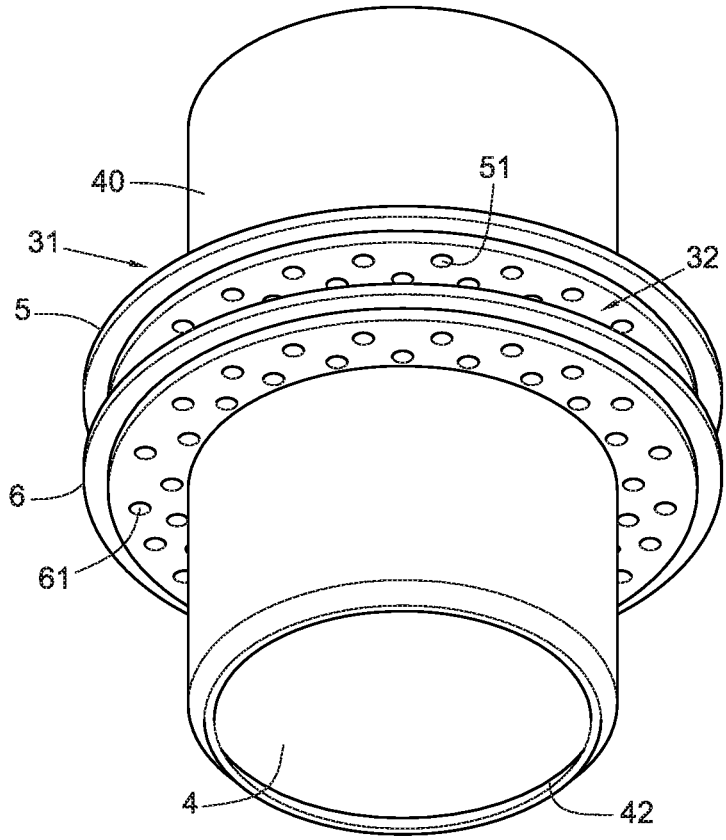
FIG. 5 shows a three-dimensional view of the duct and partitions.
Figure 6:
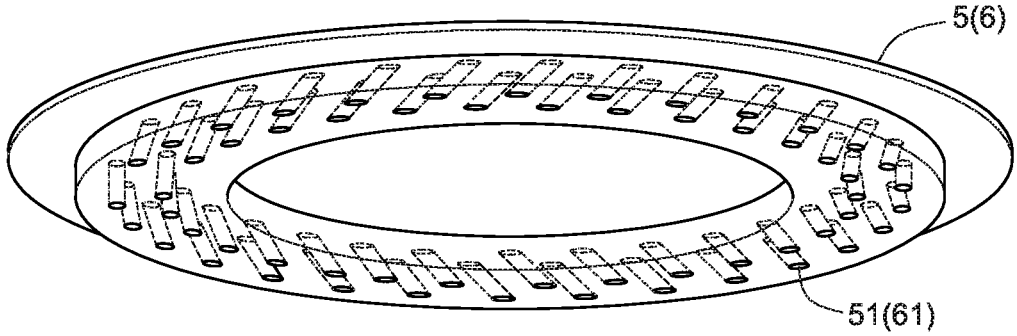
FIG. 6 shows a three-dimensional view of the partitions.

As shown in FIG. 1 and FIG. 3, the exhaust gas passage 4 is formed inside a circular duct 40, which has a vertical arrangement and is in the center of the inlet head 3. The exhaust gas passage 4 further forms an exhaust gas inlet 41 that is on the top of the inlet head 3 and is connected to the exhaust gas supply terminal 11. The exhaust gas passage 4 also forms an exhaust gas outlet 42 that is on the bottom of the inlet head 3 and is connected to the reaction chamber 20 of the exhaust gas processing tank 2, so that the exhaust gas passage 4 is connected between the exhaust gas supply terminal 11 and the reaction chamber 20 of the exhaust gas processing tank 2 and hence can guide the exhaust gas to flow downwards into the reaction chamber 20 of the exhaust gas processing tank 2. Both the upper partition 5 and the lower partition 6 have annular shapes, as shown in FIG. 6; they encircle the outer wall of the duct 40 (see FIG. 4 and FIG. 5 for more details) and lie between the surrounding of the duct 40 (that encompasses the exhaust gas passage 4) and the inner wall of the inlet head 3. The lower partition 6 is beneath the upper partition 5, and outside the duct 40 of the exhaust gas passage 4. An ignition chamber 32 is formed between the surrounding of the duct 40 (which contains the exhaust gas passage 4), the inner wall of the inlet head 3, and the upper and lower partitions 5 and 6.

Figure 3A:
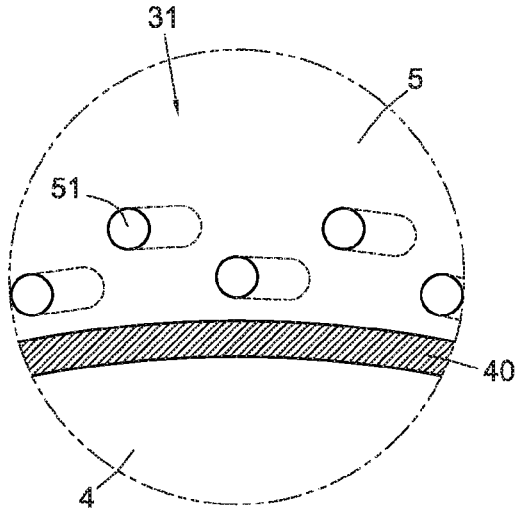
FIG. 3*a* shows a partially enlarged view of FIG. 3.

As shown in FIG. 2 and FIG. 3, the upper inclined holes 51 scatter (in a vortex pattern) on the upper partition 5, and surrounds the duct 40, which encompasses the exhaust gas passage 4 (see FIG. 3*a* and FIG. 6 for more detail). A combustion gas chamber 31 is formed between the inner wall of the inlet head 3, the surrounding of the duct 40 (which encompasses the exhaust gas passage 4), and the top of the upper partition 5, and is connected to the tops of the upper inclined holes 51. The outer wall of the inlet head 3 has a combustion gas inlet 311 that is connected to the combustion gas chamber 31 and the combustion gas supply terminal 12. The bottoms of the upper inclined holes 51 are connected to the ignition chamber 32, so that the upper inclined holes 51 interconnect the combustion gas supply terminal 12 and the ignition chamber 32. The combustion gas supply terminal 12 supplies a combustion gas, which contains oxygen, to the combustion gas chamber 31 of the inlet head 3. The combustion gas chamber 31 equally supplies the combustion gas to each of the upper inclined holes 51. The upper inclined holes 51 can guide the combustion gas in the combustion gas chamber 31 to swirl downwards into the ignition chamber 32, so that the combustion gas can swirl downwards within the ignition chamber 32. Inside the combustion gas chamber 31 there is a container pipe 33 that is connected to the ignition chamber 32. The igniter 7 is planted inside the container pipe 33, and extends into the ignition chamber 32. The container pipe 33 has a plurality of air vents 331; they connect the interior of the container pipe 33 and the combustion gas chamber 31. They guide the combustion gas in the combustion gas chamber 31 into the container pipe 33, which will then be ignited by the igniter 7 and becomes a pilot light flame 91 (as shown in FIG. 7). The pilot light flame 91 ignites the combustion gas in the ignition chamber 32 to form a flame 92 that swirls downwards, passes through the outer wall of the duct 40, and heats up the exhaust gas in the exhaust gas passage 4.

Figure 4:
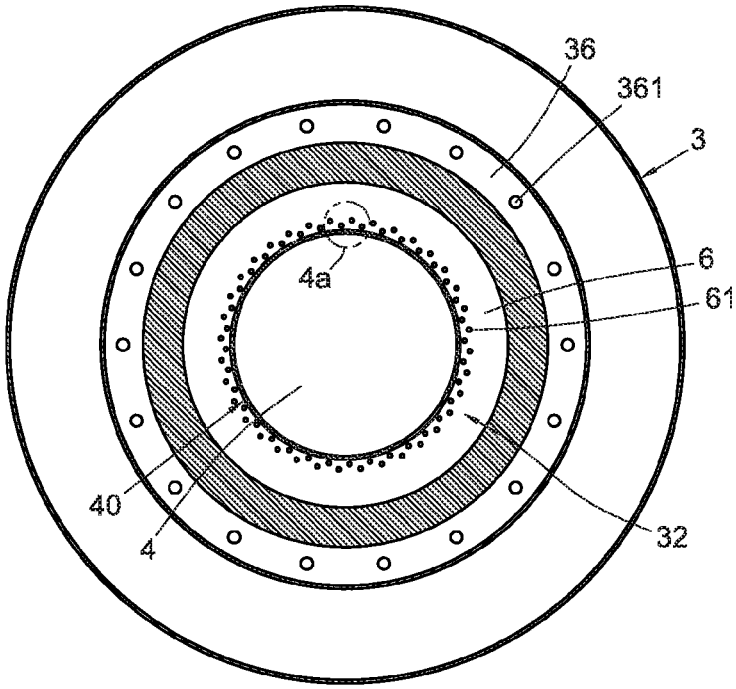
FIG. 4 shows a cross-sectional view along the line B-B in FIG. 2.
Figure 4A:
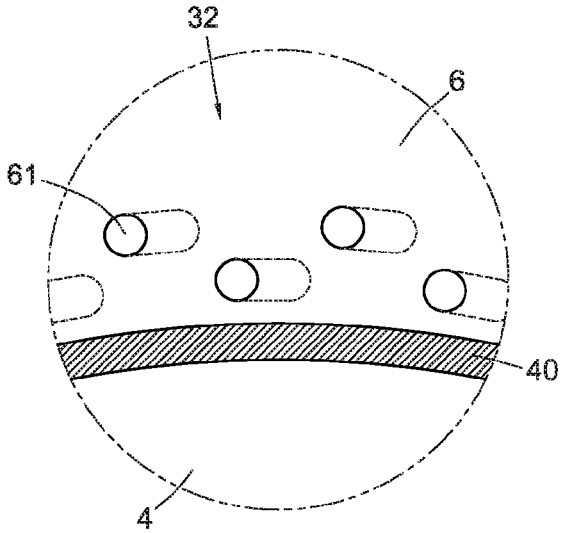
FIG. 4*a* shows a partially enlarged view of FIG. 4.

The lower inclined holes 61 scatter (in a vortex pattern) on the lower partition 6 (as shown in FIG. 2 and FIG. 4) and surround the duct 40, which encompasses the exhaust gas passage 4 (see FIG. 4*a* and FIG. 6 for more detail). The upper and lower inclined holes 51 and 61 have the same vortex direction. The lower inclined holes 61 interconnects the ignition chamber 32 and the reaction chamber 20 of the exhaust gas processing tank 2; it can guide the flame 92 in the ignition chamber 32 to swirl downwards into the reaction chamber 20 of the exhaust gas processing tank 2. The flame 92 will keep swirling in the reaction chamber 20 downwards. Around the bottom of the inlet head 3 there is a ring sheath 34 extending downwards into the exhaust gas processing tank 2. The interior of the ring sheath 34 has a combustion chamber sink 341 located on a corresponding end beneath the exhaust gas passage 4 and the lower inclined holes 61. The combustion chamber sink 341 interconnects the exhaust gas passage 4 and the lower inclined holes 61. The bottom of the combustion chamber sink 341 has a sink opening 342 that is connected to the reaction chamber 20 of the exhaust gas processing tank 2. The lower overflow opening 23 can be formed between the top of the lower sink 21 and the outer wall of the ring sheath 34.

Between the surrounding of the ignition chamber 32 and the inner wall of the inlet head 3 there is an upper sink 35 (as shown in FIG. 1) that is annular in shape and a collecting trough 36 (see FIG. 3) that is also annular in shape. The collecting trough 36 is on the top of the upper sink 35. A plurality of drainage holes 361 interconnect the collecting trough 36 and the upper sink 35. The outer wall of the inlet head 3 has a first water inlet 362 that interconnects the collecting trough 36 and the external wash water supply terminal 13. Therefore wash water can be supplied into the upper sink 35 from the collecting trough 36 and the holes 361. An upper overflow opening 351, which is annular in shape, interconnects the top of the upper sink 35 and the combustion chamber sink 341 inside the exhaust gas processing tank 2. Therefore, the wash water inside the upper sink 35 can be guided to overflow to the inner wall of the combustion chamber sink 341 (as shown in FIG. 7), and to spill down along the inner wall of the reaction chamber 20 of the exhaust gas processing tank 2. As a result, the water will form an inner water screen 82 on the inner side of the outer water screen 81.

The present invention further provides a method that can be used with the whirlwind-type oxidation combustion apparatus discussed above. The method includes the following steps:

(1) The wash water supply terminal 13 supplies wash water to the first and second water inlets 362 and 22 at the same time, so that the outer water screen 81 and the inner water screen 82 are formed on the inner wall of the reaction chamber 20 and on the inner wall of the combustion chamber sink 341, respectively.

Figure 8:
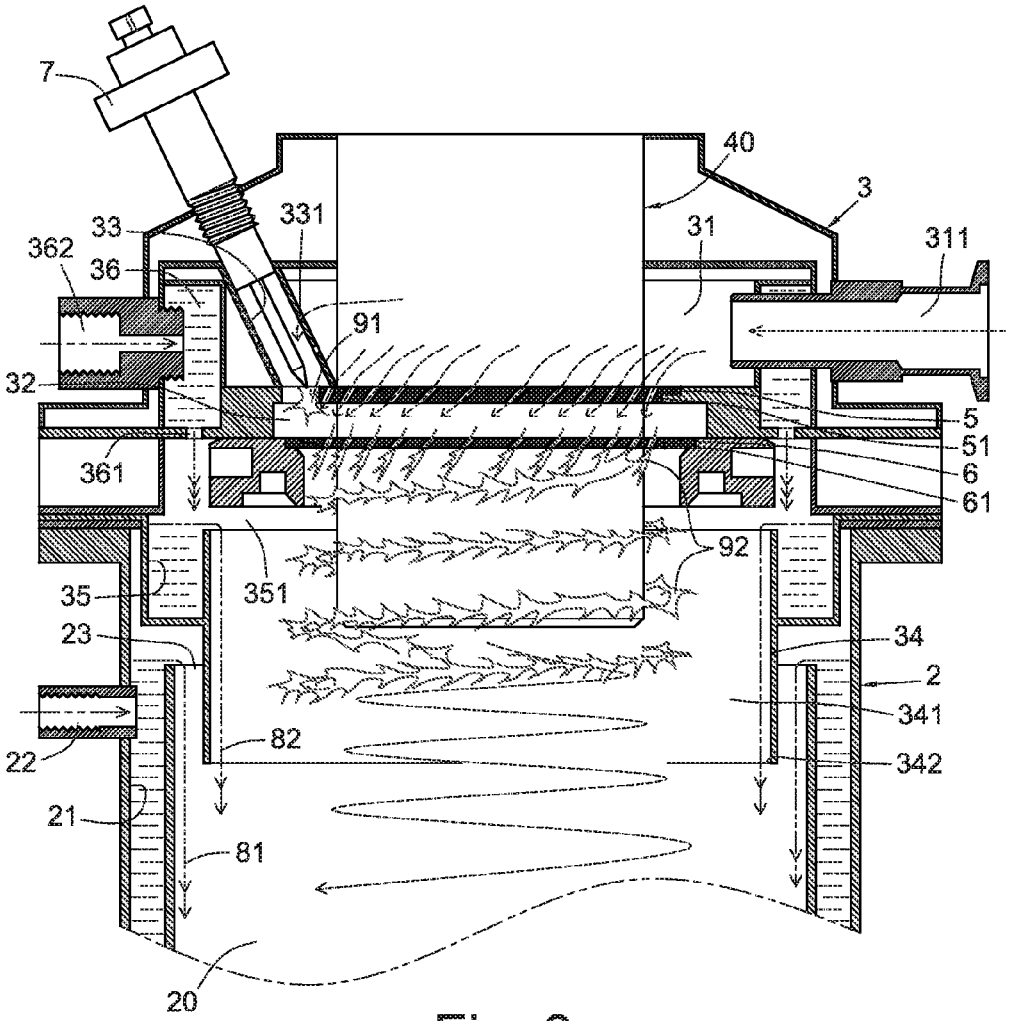
FIG. 8 shows how the embodiment in FIG. 2 operates.

(2) The combustion gas supply terminal 12 keeps supplying the combustion gas, which contains oxygen, into the combustion gas chamber 31 through the combustion gas inlet 311 (as shown in FIG. 7). This will force the combustion gas to be guided by the upper inclined holes 51, swirl down into the ignition chamber 32 (see FIG. 8), and keeps swirling down within the ignition chamber 32. In the meantime, a part of the combustion gas will enter the container pipe 33 through the air vents 331, and permeates around the igniter 7.

(3) The igniter 7 generates electric arc sparkle (see FIG. 7) to ignite the combustion gas inside the container pipe 33 to produce the pilot light flame 91. The pilot light flame 91 will ignite the combustion gas inside the ignition chamber 32 to form a flame 92 swirling down (see FIG. 8). This maintains the interior of ignition chamber 32 at a burning state. Furthermore, the flame 92 will be guided by the lower inclined holes 61 to swirl down into the combustion chamber sink 341. The flame 92 will keep swirling down within the combustion chamber sink 341 and the reaction chamber 20 and form a concentrated vortex fire inside the combustion chamber sink 341.

Through controlling the amount of the oxygen-containing combustion gas supplied to the inlet head 3, the combustion gas supply terminal 12 can control the swirling speed of the flame 92. The more combustion gas is supplied, the faster the flame 92 will swirl. The lesser combustion gas is supplied, the slower the flame 92 will swirl.

(4) Open the exhaust gas supply terminal 11 to supply the semiconductor fabrication exhaust gas into the exhaust gas passage 4 through the exhaust gas inlet 41 (see FIG. 7), so that the exhaust gas will pass through the exhaust gas inlet 41, the exhaust gas passage 4, the exhaust gas outlet 42, the combustion chamber sink 341, and the reaction chamber 20 in turn.

In the mean time, the flame 92 will pre-heat the exhaust gas inside the exhaust gas passage 4 through the outer wall of the duct 40. This can reduce the time required by the harmful objects in the exhaust gas to be catalyzed by high temperature to become harmless objects. The flame 92, which is swirling down, will burn the exhaust gas, which comes from the exhaust gas outlet 42 of the exhaust gas passage 4 and enters the combustion chamber sink 341 and the reaction chamber 20 of the exhaust gas processing tank 2 (see FIG. 8). The high temperature of the flame 92 will catalyze the harmful objects in the exhaust gas to decompose into harmless objects. The concentrated swirling fire formed by the flame 92 will swirl the exhaust gas and fling the exhaust gas onto the inner and outer water screens 82 and 81, causing the dust and the fluorine ions and other objects (that can be washed away) in the exhaust gas to collide with, dissolve in, and then be discharged with the water screens 82 and 81. This will convert the exhaust gas into a harmless one. Furthermore, the water screens 82 and 81 will also cool down the exhaust gas.

Based upon above, because the upper and lower inclined holes 51 and 61 have the same swirling direction, after the combustion gas, which swirls into the ignition chamber 32 through the upper inclined holes 51, is ignited and becomes the flame 92, the combustion gas will swirl into the exhaust gas processing tank 2 through the lower inclined holes 61 and forms the flame 92 that swirls down. This will cause the exhaust gas in the combustion chamber sink 341 of the exhaust gas processing tank 2 to swirl downwards.

Accordingly, the vortex flame 92 will cause the semiconductor fabrication exhaust gas to swirl down and pass through the high temperature flame, which is also swirling, and the wash water. This gives the exhaust gas more time to interact with the swirling flame and the wash water so that the exhaust gas will receive more uniform heating. As a result, this prevents the exhaust gas from leaving the swirling fire of the flame 92 without receiving enough heat. In the mean time, the upper and lower inclined holes 51, 61 will increase the pressure of the combustion gas, causing the vortex flame 92 to form a concentrated swirling fire and increasing the efficiency of the flame in eliminating the harmful objects in the exhaust gas. Furthermore, the water screens 81 and 82 dissolve the harmful objects of the exhaust gas and prevent the harmful objects from adhering to the inner wall of the exhaust gas processing tank 2. This further prevents the inner wall of the exhaust gas processing tank 2 from dirt accumulation or erosion.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A whirlwind-type oxidation combustion apparatus for processing a semiconductor fabrication exhaust gas, an inlet head being set in between an exhaust gas supply terminal and a combustion gas supply terminal, the inlet head being located on the top of an exhaust gas processing tank, an outer water screen forming on the inner wall of the exhaust gas processing tank, the inlet head comprising:

an exhaust gas passage, interconnecting the exhaust gas supply terminal and the exhaust gas processing tank, for guiding the exhaust gas into the exhaust gas processing tank;

an upper partition and a lower partition, lying in between the surrounding of the exhaust gas passage and the inner wall of the inlet head, an ignition chamber being formed in between the surrounding of the exhaust gas passage, the inner wall of the inlet head, and the upper and lower partitions;

a plurality of upper inclined holes, scattering in a vortex pattern on the upper partition and encircling the surrounding of the exhaust gas passage, the upper inclined holes interconnecting the combustion gas supply terminal and the ignition chamber and guiding the combustion gas to swirl into the ignition chamber;

an igniter planted in the ignition chamber, for igniting the combustion gas in the ignition chamber to form a vortex flame to heat up the exhaust gas in the exhaust gas passage; and a plurality of lower inclined holes, scattering in a vortex pattern on the lower partition and encircling the surrounding of the exhaust gas passage, the lower inclined holes interconnecting the ignition chamber and the exhaust gas processing tank, the lower inclined holes guiding the flame to swirl into the exhaust gas processing tank to combust the exhaust gas entered from the exhaust gas passage into the exhaust gas processing tank, the lower inclined holes further causing the exhaust gas to swirl onto the water screen.

2. The apparatus of claim 1, wherein a combustion gas chamber is formed between the surrounding of the exhaust gas passage, the top of the upper partition, and the inner wall of the inlet head, the combustion gas chamber is connected to the combustion gas supply terminal and the upper inclined holes.

3. The apparatus of claim 2, wherein the combustion gas chamber has a container pipe that is connected to the ignition chamber, the igniter is set inside the container pipe, and the container pipe has a plurality of air vents that interconnect the interior of the container pipe and the combustion gas chamber, for guiding the combustion gas into the container pipe.

4. The apparatus of claim 1, wherein a combustion chamber sink is set on a corresponding end beneath the exhaust gas passage and the lower inclined holes, the combustion chamber sink is connected to the exhaust gas passage and the lower inclined holes, and the bottom of the combustion chamber sink has a sink opening that is connected to the exhaust gas processing tank.

5. The apparatus of claim 1, wherein an annular upper sink is formed between the surrounding of the ignition chamber and the inner wall of the inlet head for guiding in external wash water, an upper overflow opening interconnects the upper sink and the interior of the exhaust gas processing tank for guiding the wash water to overflow into the exhaust gas processing tank to form an inner water screen on the inner side of the outer water screen, the inner water screen is to be blown by the exhaust gas.

6. The apparatus of claim 5, wherein an annular collecting trough is formed between the surrounding of the ignition chamber and the inner wall of the inlet head, the annular collecting trough is connected to the upper sink and locates on the top of the upper sink, and the external wash water is guided into the upper sink through the collecting trough.

7. The apparatus of claim 1, wherein an annular lower sink is formed on the inner wall of the exhaust gas processing tank for guiding in external wash water, a lower overflow opening interconnects the lower sink and the interior of the exhaust gas processing tank, the lower overflow opening guides the wash water to overflow into the exhaust gas processing tank to form the outer water screen.

* * * * *